US005904583A

United States Patent [19]

Katsuma et al.

[11] Patent Number: 5,904,583

[45] **Date of Patent: *May 18, 1999**

[54] LEVER CONNECTOR

[75] Inventors: Takatoshi Katsuma; Hisashi Kounoya, both of Yokkaichi, Japan

[73] Assignee: Sumitomo Wiring Systems, Ltd., Yokkaichi City, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,520

[22] PCT Filed: Nov. 7, 1994

[86] PCT No.: PCT/JP94/01873

§ 371 Date: Jun. 4, 1996

§ 102(e) Date: Jun. 4, 1996

[87] PCT Pub. No.: WO95/12906

PCT Pub. Date: May 11, 1995

[30] Foreign Application Priority Data

Nov. 5, 1993 [JP] Japan ..... 5-064286 U
Nov. 8, 1993 [JP] Japan ..... 5-064758 U

[51] Int. Cl.[6] ..... H01R 13/62
[52] U.S. Cl. ..... 439/157
[58] Field of Search ..... 439/157, 310

[56] References Cited

U.S. PATENT DOCUMENTS 5,171,156 12/1992 Nagasaka et al. ..... 439/157
5,178,553 1/1993 Hatagishi et al. ..... 439/157
5,183,408 2/1993 Hatagishi et al. ..... 439/157
5,205,752 4/1993 Taguchi et al. ..... 439/157
5,230,635 7/1993 Takenouchi et al. ..... 439/157
5,257,942 11/1993 Taguchi ..... 439/157
5,320,544 6/1994 Naoto et al. ..... 439/157
5,499,926 3/1996 Akeda ..... 439/157
5,790,373 8/1998 Kim et al. ..... 439/157

FOREIGN PATENT DOCUMENTS 4404112 8/1994 Germany .

*Primary Examiner*—Paula Bradley
*Assistant Examiner*—Tho D. Ta
*Attorney, Agent, or Firm*—Wenderoth, Lind & Ponack, L.L.P.

[57] ABSTRACT

Protrusions 35 are formed on cam grooves 33 of arm 32 of a lever 30 for the purpose of holding connector housings 10 and 20 in a preliminary fitted state. Engagement pins 12 are prevented from disconnecting from the respective cam grooves 33 when the female connector housing 10 is inserted slightly into a hood 21 of the male connector housing 20 such that he connector housings 10 and 20 are held in the preliminary fitted state. Accordingly, the lever 30 can be turned smoothly. Since no hole communicating between the interior and the exterior of the connector is formed in the inner part of the hood 21, there is no possibility that water may penetrate into the hood 21.

8 Claims, 12 Drawing Sheets

LEVER CONNECTOR

TECHNICAL FIELD

The present invention relates to lever connectors in which two connector housings are fitted to each other by turning a lever thereof.

BACKGROUND ART

FIG. 6 illustrates a conventional lever connector. Of two connector housings 50 and 60 fitted to each other, a female connector housing 50 has two engagement pins 51 projecting from respective opposite side walls. The male connector housing 60 has two support shafts 61 formed on respective opposite side walls thereof and a lever 62 whose arms 63 extend from both ends of the lever and are rotatably mounted on the support shafts 61.

In connecting the connector housings 50 and 60 together, the female connector housing 50 is inserted slightly into a hood 64 of the male connector housing 60 so that engagement pins 51 enter openings of respective cam grooves 65 formed in the arms 63. With insertion of the female connector housing 50 into the hood 64, a protrusion 52 formed on the underside of the female connector housing 50 and a protrusion 66 formed on the bottom of the hood 64 of the male connector housing 60 move over each other, 25 thereby being engaged with each other. As a result of the engagement of the protrusions 52 and 66, each of the connector housings 50 and 60 is prevented from being moved in a direction in which they come apart from each other. Thus, both connector housings 50 and 60 are held in a preliminary fitted state wherein the engagement pins 51 are located in the respective cam grooves 65, as shown in FIG. 7.

Subsequently, the lever 62 is turned in the above-described state. Both connector housings 50 and 60 are held in the preliminary fitted state such that there is no possibility of disengagement of the engagement pins 51 from the respective cam grooves 65. Accordingly, the lever 62 can be turned smoothly and reliably. By engagement of the pins 51 with the respective cam grooves 65 caused by the turning of the lever 62, the female and male connector housings 50 and 60 are drawn nearer to each other, whereupon both connector housings are connected together in a final fitted state.

As described above, the conventional lever connector employs, as a means for holding both connector housings in preliminary fitted state, a method of engaging the protrusion 52 formed on the underside of the female connector housing 50 and the protrusion 66 formed on the bottom of the hood 64 of the male connector housing 60 with each other.

However, this preliminary engaging means has the following problem. That is, a metal mold for forming a bottom face lying at the rear of the protrusion 66 needs to be drawn out when the protrusion 66 is formed on the bottom of the hood 64 of the male connector housing 60. Accordingly, a mold drawing hole 67 open to the outside of the hood 64 is formed in the inner end face of the hood 64. Consequently, the interior of the connector communicates with the exterior thereof through the hole 67 in the state where both connector housings 50 and 60 are in fitting engagement. There is thus a possibility that water may penetrate into the connector to thereby wet the terminals therein.

Another prior art lever connector will be described with reference to FIG. 16.

Of two connector housings fitted to each other, the male connector housing 170 has two support shafts 171 formed on opposite side walls thereof, respectively, and a lever 172 which is formed into a U-shape and which has plate-shaped arms 173 extending from both ends thereof and rotatably mounted on the support shafts 171 in the same manner as in the foregoing prior art lever connector. The female connector housing has two engagement pins formed on opposite side walls thereof and engaged with cam groove 174 formed in the inner side, faces of the arms, respectively. In the connection of both connector housings, the female connector housing is slightly inserted into the hood 175 of the male connector housing 170 so that the engagement pins enter openings of cam grooves 174 of the arms 173, respectively. Upon turning of the lever 172 in this state, the female connector housing and the male connector housing 170 are drawn nearer to each other by the engagement of the engagement pins with the respective cam grooves 174 caused by the turning of the lever 172, thereby being connected together.

In the above-described lever connector, an excessively large torque is applied to each arm 173 when the lever 172 is turned. Accordingly, the arms 173 tend to be flexed outwardly such that the engagement pins are disengaged from the cam grooves 174, respectively. If the arms 173 should be flexed outwardly, they would be disconnected from the respective support shafts 171. In view of the this problem, falling-off preventing walls 176 are provided on the outer side faces of the male connector housing 170 for preventing the arms 173 from being flexed and falling off of the support shafts 171.

Each conventional falling-off preventing wall 176 has a portion extending outwardly from the side wall of the male connector housing 170 in the shape of a plate, the portion being bent so as to face the outer face of the arm 171, as shown in FIG. 7. When the arm 173 is flexed outwardly, the inner face of the falling-off preventing wall 176 is caused to abut against the outer face of the arm 173, thereby preventing the arm 173 from being flexed outwardly and consequently preventing the falling-off of the arm 173 from the support shaft 171.

However, each falling-off preventing wall 176 is located outside the arm 173. This increases the width of the male connector housing 170. Consequently, the connector cannot be mounted, or the mounting work is rendered difficult when a mounting space for the connector is small, or when there is some limitation in the mounting location or direction of the connector. This problem occurs in the case where the lever is mounted on the female connector housing as well as on the male connector housing.

SUMMARY OF THE INVENTION

The present invention has been made in view of the foregoing circumstances. An object thereof is to provide a lever connector with preliminary fitting means which can exclude the possibility of the penetration of water into the 10 inner part of the hood of the male connector housing.

As a means for solving the above-described problem, the present invention provides a lever connector wherein a female connector housing is fitted into a hood of a male connector housing and both connector housings are held in a preliminary fitted state by inserting an engagement pin provided on one connector housing into a cam groove of a lever mounted on the other connector housing so that the engagement pin assumes a preliminary fitting position. Both connector housings are fitted into a final fitted state by engagement of the engagement pin with the cam groove upon turning of the lever. The cam groove is formed with a protrusion allowing the engagement pin to be inserted into the cam groove so that the engagement pin assumes the preliminary fitting position and prevents the engagement pin from falling out of the preliminary fitting position outside the cam groove.

In connection of both connector housing, when the female connector is inserted slightly into the hood of the male connector housing, the engagement pin enters the cam groove of the lever, passing the protrusion and assuming the preliminary fitting position. In this state, the engagement pin assuming the preliminary fitting position is prevented from being disconnected from the cam groove by the protrusion, whereby both connector housings are held in the preliminary fitted state.

Upon operation of the lever in the preliminary fitted state, the lever is smoothly turned because there is no possibility of disengagement of the engagement pin from the cam groove. The female and male connector housings are drawn nearer to each other by the engagement of the engagement pin with the cam groove caused by the turning of the lever, thereby being connected into a final fitted state.

As described above, the protrusion is formed in the cam groove of the lever as a means for holding both connector housings in the preliminary fitted state, and the engagement pin is engaged with the protrusion. Accordingly, a mold drawing hole need not be formed in the hood, although it is required in the prior art, where the protrusion is provided in the hood of the male connector housing. Consequently, the waterproofing in the hood can be improved.

The present invention further provides a lever connector wherein an engagement pin is formed on one of two connector housings and a lever is held on the other connector housing and is engaged with the engagement pin to draw the same near thereto so that both connector housings are fitted. The one connector housing has a hood into which the other connector housing is inserted. Each of the lever and the engagement pin is provided with an engagement mechanism so as to be engaged with each other in a manner of a concavo-convex engagement.

More specifically, the engagement mechanism is formed on the lever and the engagement pin, which are engaged with each other. Without a specific protrusion formed in the hood, the engagement pin and the lever are engaged with each other in the manner of a concavo-convex engagement in the preliminary fitted state, whereby the connector housings are held in the preliminary fitted state.

Consequently, a mold drawing hole provided in the prior art need not be formed in the hood, and accordingly the waterproofing in the hood can be improved.

The present invention further provides a lever connector with a lever that has a cam groove which is formed around an axis of rotation thereof and into which the engagement pin is insertable. The cam groove has one of two ends open at an end of the lever and approaches the rotation axis as the same extends toward the other end thereof. A protrusion is formed in the vicinity of the open end of the cam groove, the protrusion engaging the engagement pin in concavo-convex engagement.

Since the protrusion is provided in the groove into which the engagement pin is inserted, the engagement pin gets over the protrusion when inserted into the cam groove so that both connector housings are preliminarily fitted with each other. After having gotten over the protrusion, the engagement pin is prevented from going backward and is held in position.

The present invention further provides a lever connector where the protrusion is formed on a side wall of the cam groove so as to abut against a side surface of the engagement pin, thereby engaging the same.

Since the protrusion is formed so as to abut against the side face of the engagement pin, the protrusion reliably abuts against the engagement pin even when the lever and the engagement pin are axially displaced. Consequently, the connector housings can be readily held in the preliminary fitted state.

In further view of the above-described problems, the present invention provides a lever connector in which the arms of a lever can be prevented from being flexed outwardly and falling off of respective shafts without an increase in the width of the connector housing.

In a first lever connector, arms formed to extend from both ends of a lever are rotatably mounted on support shafts projecting from opposite side walls of one of two connector housing connected together. Engagement pins project from opposite side walls of the other connector housing and engage cam grooves formed on respective inner faces of the arms. Both connector housings are drawn nearer to each other to thereby be connected together by the engagement of the engagement pins with respective cam grooves caused by the turning of the lever. The first lever connector is characterized in that the falling-off preventing engagement portions are formed on the outer peripheral faces of the arms so as to be located inside the outer faces of the respective arms, that falling-off preventing walls are formed on the respective outer side faces of the one connector housing, each wall having a wall surface located slightly outside the outer side face of each falling-off preventing engagement portion, and that the arms are prevented from falling off from the support shafts by engagement of the falling-off preventing engagement portions with the respective falling-off preventing walls.

A second lever connector is characterized in that each falling-off preventing engagement portion is formed to project in the shape of a plate inside the outer side face of each arm in the first lever connector.

The third lever connector is characterized in that each falling-off preventing engagement portion is formed by cutting the outer peripheral face of each arm in the shape of groove.

In a first lever connector, the falling-off of the arms from the respective support shafts is prevented by the engagement of the engagement portions with the respective walls even when each arm is flexed outwardly so as to deform in the direction of its disconnection from the support shaft.

Each engagement portion is formed to be located inside the outer side face of each arm. Moreover, an amount of outward displacement of the wall surface of each falling-off preventing wall is small relative to the outer side face of each engagement portion. Accordingly, each falling-off preventing wall is not projected outwardly relative to the arm to a large extent.

In the second lever connector, the inner side face of the falling-off preventing wall abuts against the outer side face of each plate-shaped engagement portion, whereby each arm is prevented from being flexed outwardly and disconnected from the support shaft.

In the third lever connector, each falling-off preventing wall is inserted in he groove-like engagement portion. Each arm is prevented from being flexed outwardly and falling off from the support shaft by the engagement of the inner face of the engagement portion with the falling-off preventing wall.

In the above-described lever connector, the falling-off preventing engagement portions are located inside the outer faces of the respective arms and the falling-off preventing walls are located slightly outside the outer side faces of the falling-off preventing engagement portions. Consequently, since the falling-off preventing walls are not projected outwardly relative to the respective arms to a large extent, the width of the connector housing to which the lever is attached can be rendered as small as possible.

BEST MODE FOR CARRYING OUT THE INVENTION

First Embodiment

Figure 1:
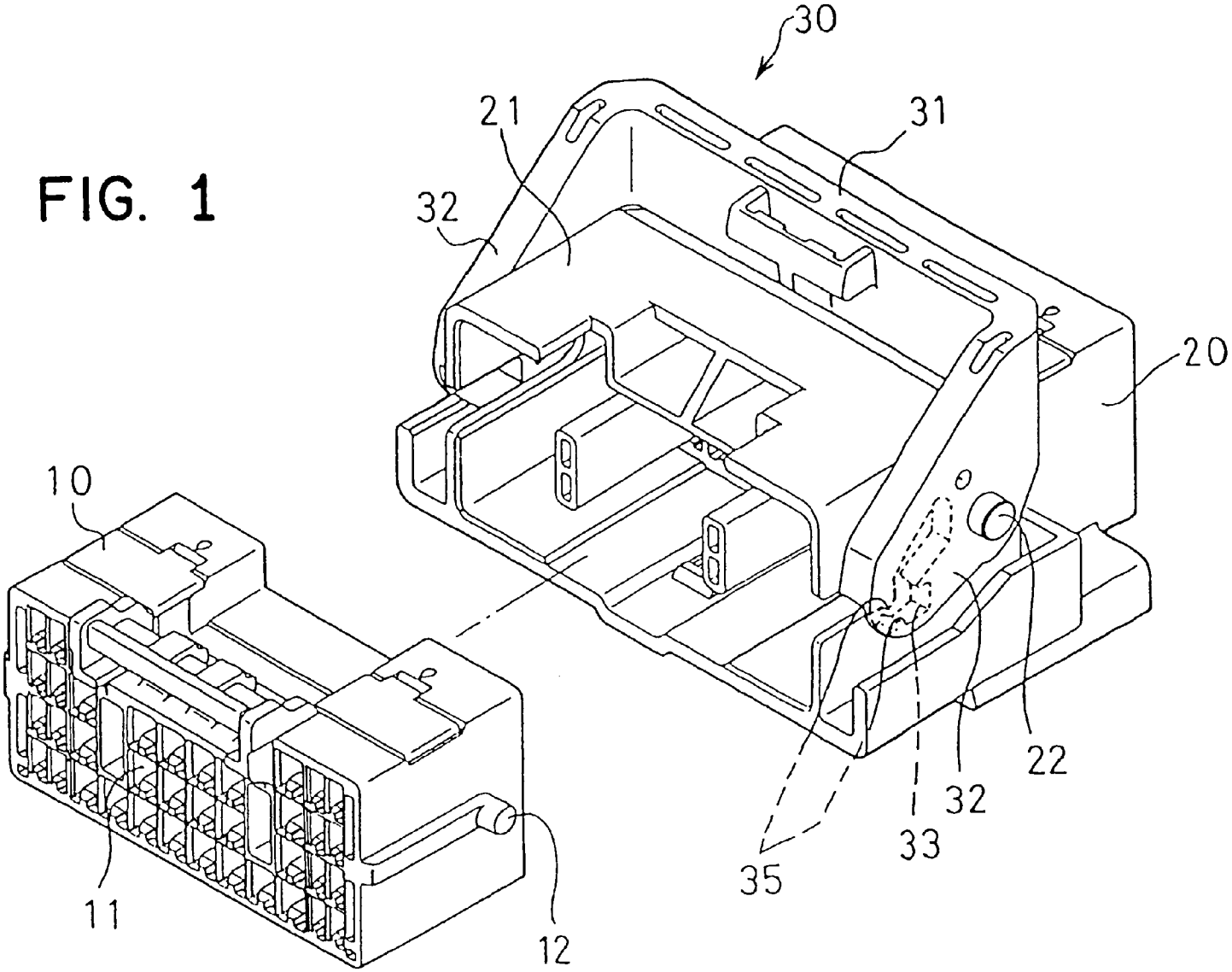
FIG. 1 is a perspective view of an overall construction of a lever connector of a first embodiment in accordance with the present invention.

A first embodiment in accordance with the present invention will be described with reference to FIGS. 1 to 5. Referring to FIG. 1, an overall construction of a lever 10 connector is shown. The lever connector comprises a female connector housing 10 and a male connector housing 20 having a hood 21 into which the female connector housing 10 is inserted. Terminals (not shown) are accommodated in cavities 11 formed in the female connector housing 10. Other terminals are also accommodated in cavities (not shown) formed in the male connector housing 20. The terminals in the female and male connector housings 10 and 20 are electrically connected together when the female and male connector housings 10 and 20 are fitted together by a fitting mechanism, which will be described later.

The fitting mechanism fitting both connector housings 10 and 20 together will be described. Coaxial engagement pins 12 having ends and side surfaces project from respective opposite side walls of the female connector housing 10. Coaxial support shafts 22 project from opposite side walls of the male connector housing 20. A generally U-shaped lever 30 formed of a synthetic resin includes a lever base 31 and two plate-shaped arms 32 extending from respective ends of the lever base 31. The arms 32 of the lever 30 are rotatably mounted on the support shafts 22. Each arm 32 of the lever 30 has a cam groove 33 formed on an inner side face thereof, each cam groove having a bottom and side walls as illustrated. The engagement pins 12 of the female connector housing 10 are engaged with the respective cam grooves 33. Each cam groove 33 is open to the outer peripheral surface of each arm 32.

The hood 21 of the male connector housing 20 has escape grooves 24 formed for allowing the engagement pins 12 to project outwardly of the hood 31 so that interaction between the hood 21 and the engagement pins 12 is avoided when the female connector housing 10 has been inserted in the hood 21. Each arm 32 of the lever 30 has two protrusions 35 located slightly inward from the opening of the cam groove 33. The protrusions 35 protrude from opposite inner faces of each arm 32 toward each other. Each protrusion 35 has a triangular shape and has inclined faces at the opening side and inward side of each respective cam groove 33. A space between distal ends of the protrusions 35 of each arm 32 is set to be slightly smaller than an outer diameter of each engagement pin 12. Provision of both protrusions 35 of each arm 32 has only one function, i.e. preventing each engagement pin 12 from returning or moving backward after each engagement pin 12 has been inserted into the cam groove 33. Accordingly, even when only one protrusion 35 is formed on either inner face of each arm 32, a concavo-convex mechanism can be constituted by the engagement pin 12 and the protrusion 35. Furthermore, the concavo-convex mechanism can be constituted even when the protrusion 35 is formed on the bottom face of each cam groove 33. In this regard, the arms 32 are flexed outwardly when the engagement pins 12 have been inserted in the respective can grooves 33. Additionally, a convexity may be formed at each engagement pin side and a concavity allowing insertion of the convexity thereinto may be formed so as to be located slightly inward from the opening of each cam groove 33.

Figure 2:
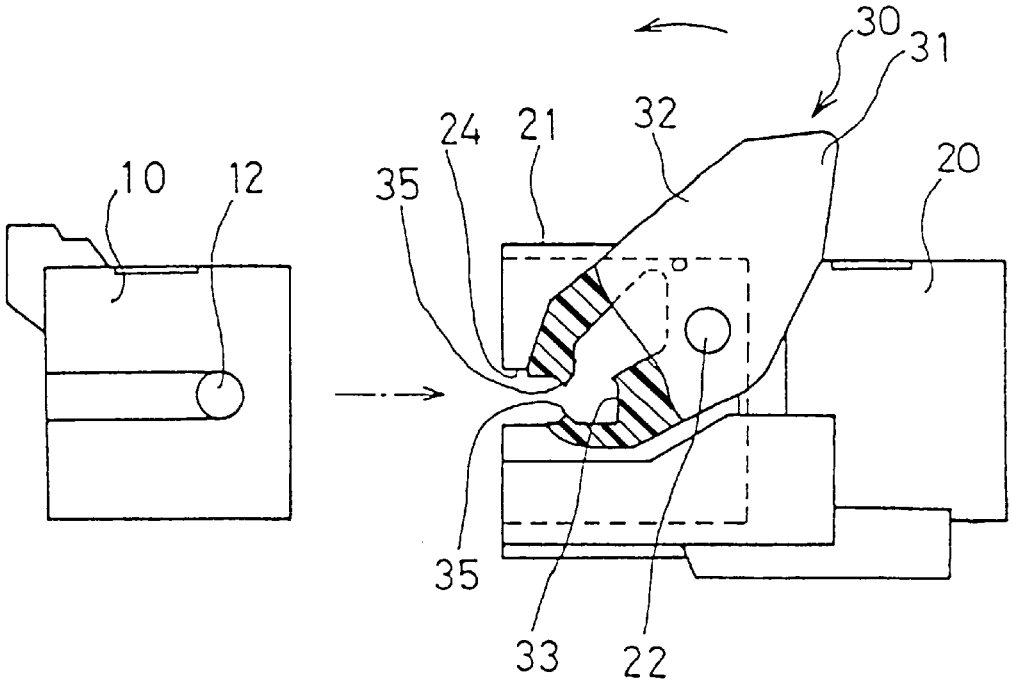
FIGS. 2 and 2*a* are side views of the lever connector with connector housings in an unfitted state.
Figure 3:
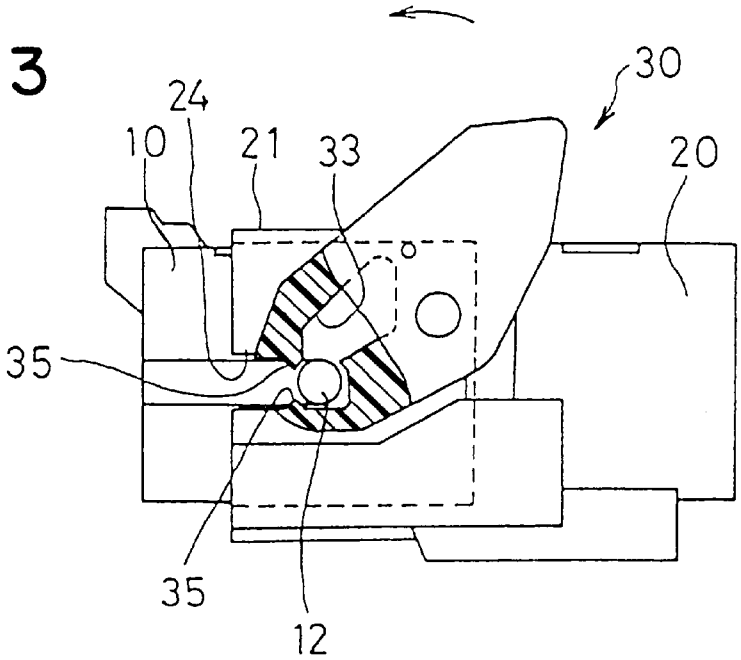
FIG. 3 is a partially cut-out side view of the lever connector with the connector housings in a preliminary fitted state.

The operation of the lever connector of the embodiment will be described. In fitting both connector housings 10 and 20 together, the lever 30 is first put into a state such that the opening of each cam groove 33 is superimposed on the escape groove 24, as shown in FIG. 2. In this state, the female connector housing 10 is slightly inserted into the hood 21. With this insertion, each engagement pin 12 advances inwardly through the opening of the cam groove 33, elastically deforming the arm 32 so that the cam groove 33 is spread, and passed through the space between the protrusions 35. Thus, each engagement pin 12 reaches a preliminary fitting position, and both connector housings 10 and 20 are put into a preliminary fitted state as shown in FIG. 3.

Since the engagement pins 12 are engaged with the protrusions 35 of the respective cam grooves 33 in the preliminary fitted state, the engagement pins 12 are prevented from coming apart from the respective cam grooves 33, whereby the connector housings 10 and 20 are held in the preliminary fitted state.

Upon turning of the lever 30 in the preliminary fitted state, both connector housings 10 and 20 are drawn nearer to each other by the engagement of the engagement pins 12 with the respective cam grooves 33 caused by the turning of the lever 30. The connector housings 10 and 20 are put into a final fitted state in which the female connector housing 10 has been inserted deep into the hood 21, whereby the terminals in both connector housings are electrically connected together.

When turning of the lever 30 is initiated in the preliminary fitted state, the engagement pins 12 are engaged with the protrusions 35 such that the engagement pins 12 are prevented from coming out of the cam grooves 33. Accordingly, the engagement of the engagement pins 12 with the respective cam grooves 33 is initiated without trouble upon turning of the lever 30 so that the lever 30 can be operated smoothly and reliably.

As described above, in the embodiment, the protrusions 35 are formed in the respective cam grooves 33 of the lever 30 as a means for holding both connector housings 10 and 20 in the preliminary fitted state, and the engagement pins 12 are engaged with the respective protrusions 35. In the conventional method, the protrusions formed on the underside of the female connector housing and in the hood of the male connector housing are engaged with each other so that the connector housings are held in the preliminary fitted state. Unlike the conventional method, a mold drawing hole need not be formed in the inner part of the hood. Consequently, since no hole communicating between the interior and the exterior of the connector is formed in the inner part of the hood 21, there is no possibility that water may penetrate into the hood 21.

The present invention should not be limited to the above-described embodiment and may be modified in practice as follows.

Figure 2A:
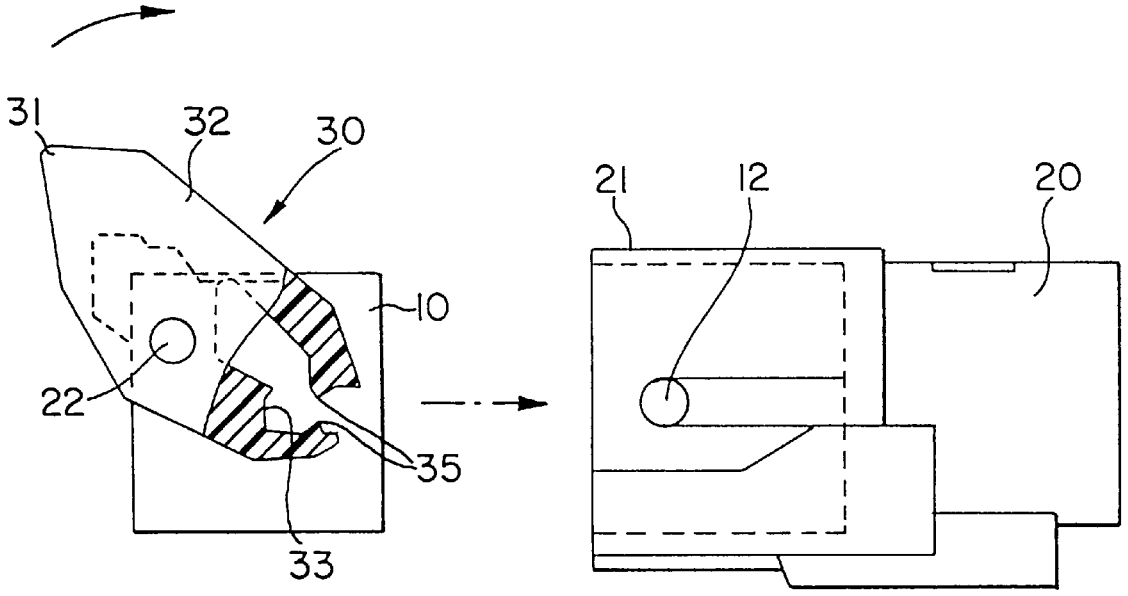
Figure 4:
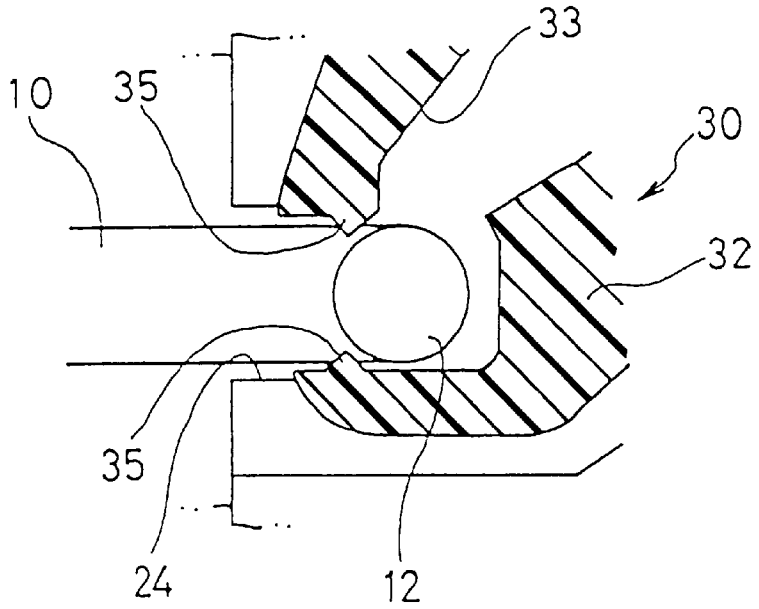
FIG. 4 is a partially enlarged and cut-out side view of the connector with the connector housings in the preliminary fitted state.
Figure 5:
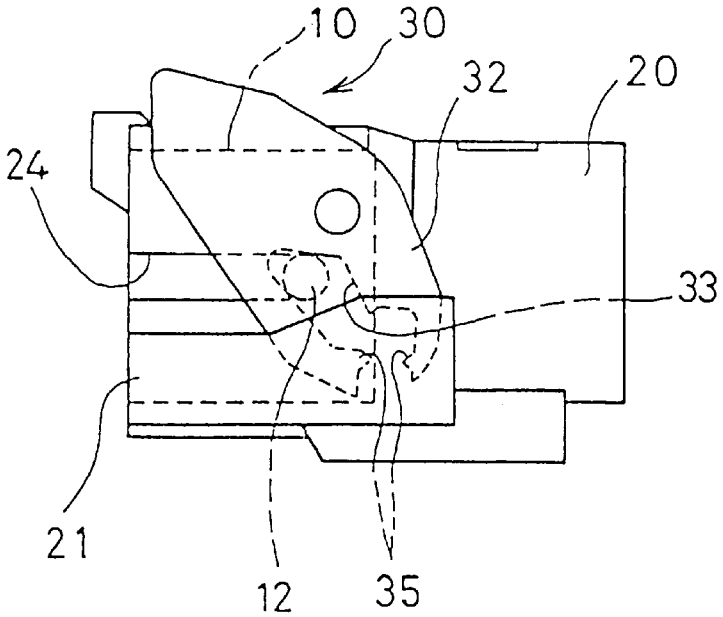
FIG. 5 is a side view of the connector with the connector housings in a final fitted state.
Figure 6:
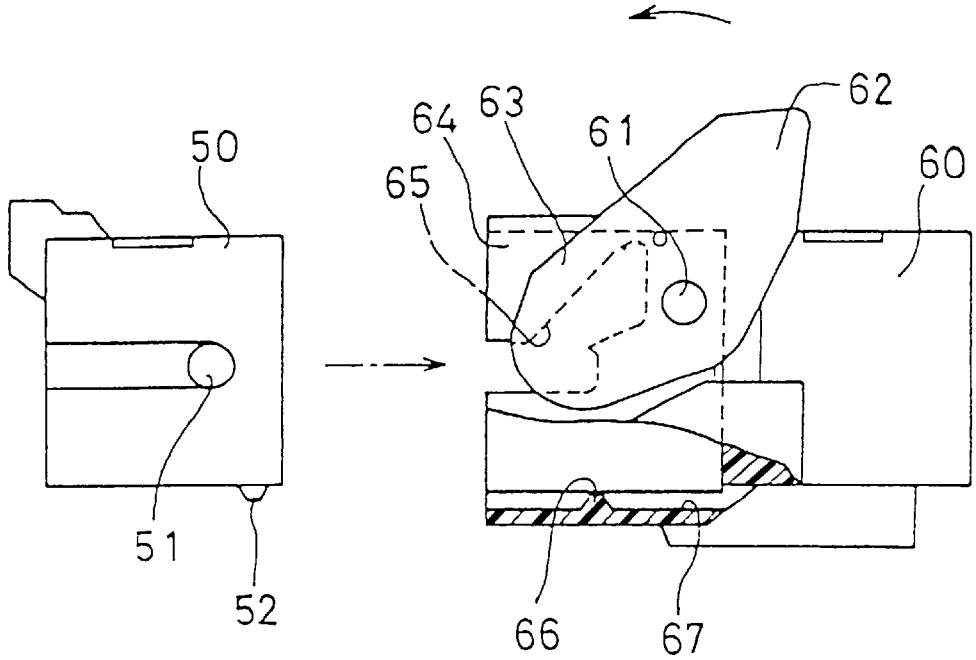
FIG. 6 PRIOR ART
FIG. 6 is a partially cut-out side view of a prior art lever connector with the connector housings in an unfitted state.
Figure 7:
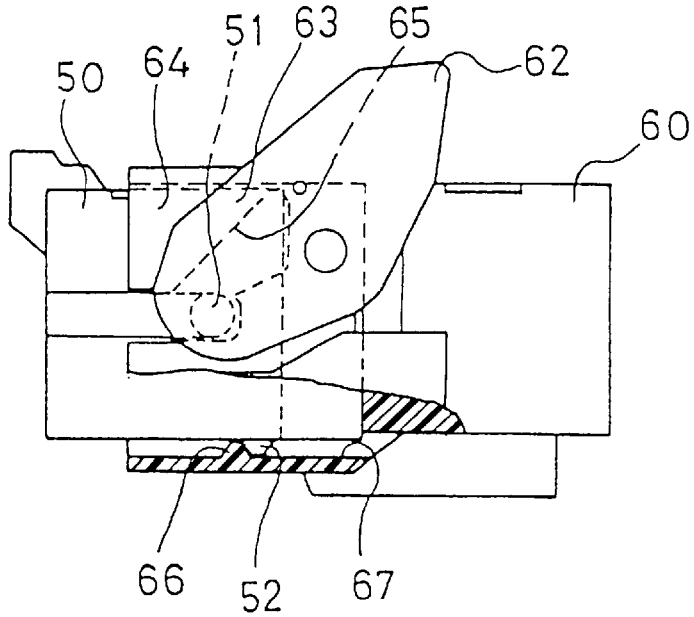
FIG. 7 PRIOR ART
FIG. 7 is a partially cut-out side view of the prior art lever connector with the connector housings in a preliminary fitted state.

(1) The lever may be mounted on the male connector housing and the engagement pins are formed on the female connector housing in the foregoing embodiment. However, the lever may be mounted on the female connector housing and the engagement pins may be formed on the male connector housing. See for example FIG. 2*a*.

(2) The protrusions holding the connector housings in the preliminary fitted state can be formed on the inner faces of each cam groove in the foregoing embodiment. The protrusion constituting the feature of the present invention should not be limited to those formed on both inner faces of the cam groove but may include ones formed on either one of the inner faces of the cam groove.

Otherwise, the present invention should not be limited to the embodiment described above with reference to the drawings, and may be modified in practice without departing from the scope of the appended claims.

Second Embodiment

Figure 8:
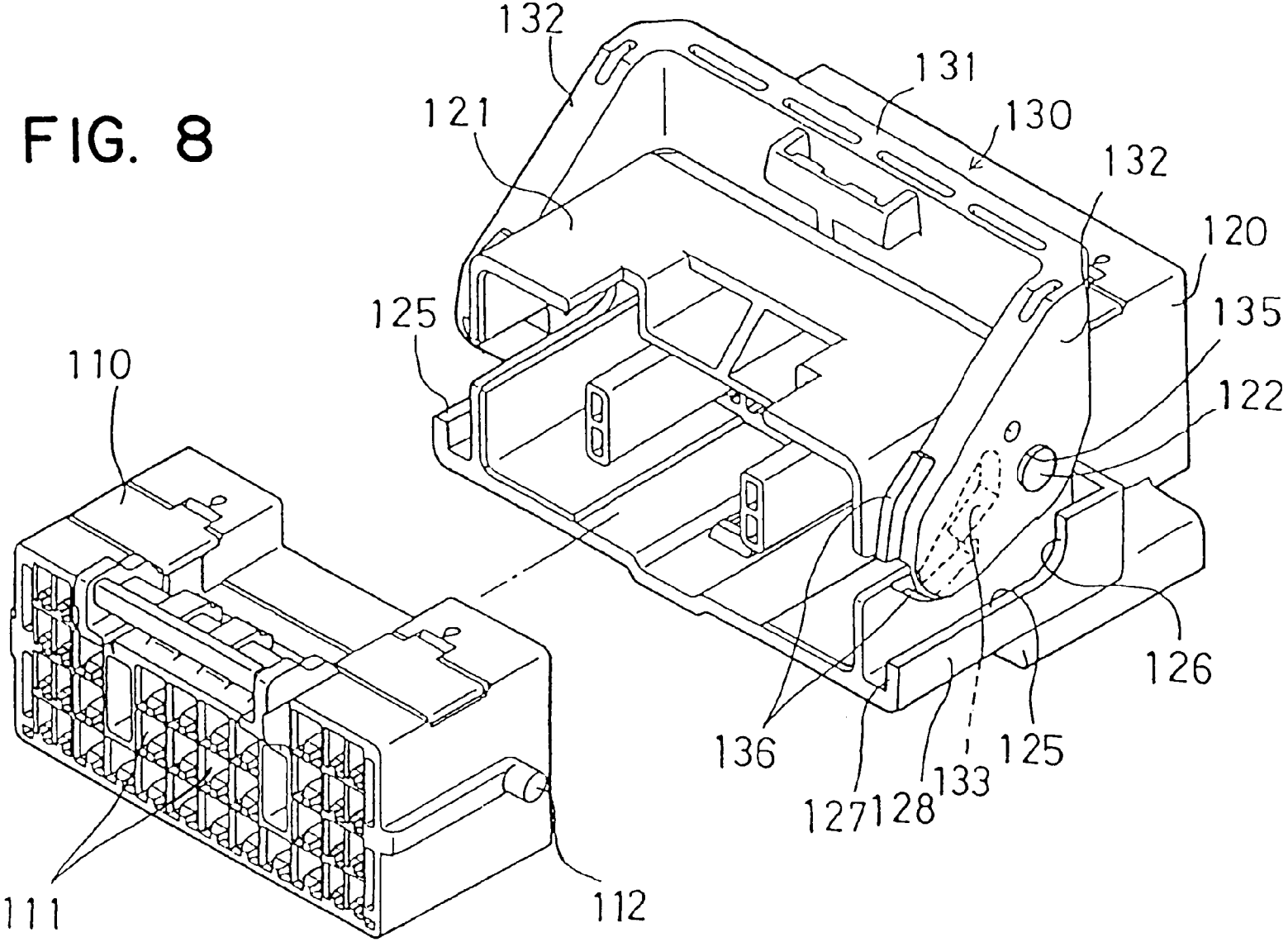
FIG. 8 is a perspective view of an overall construction of a lever connector of a second embodiment in accordance with the present invention.
Figure 9:
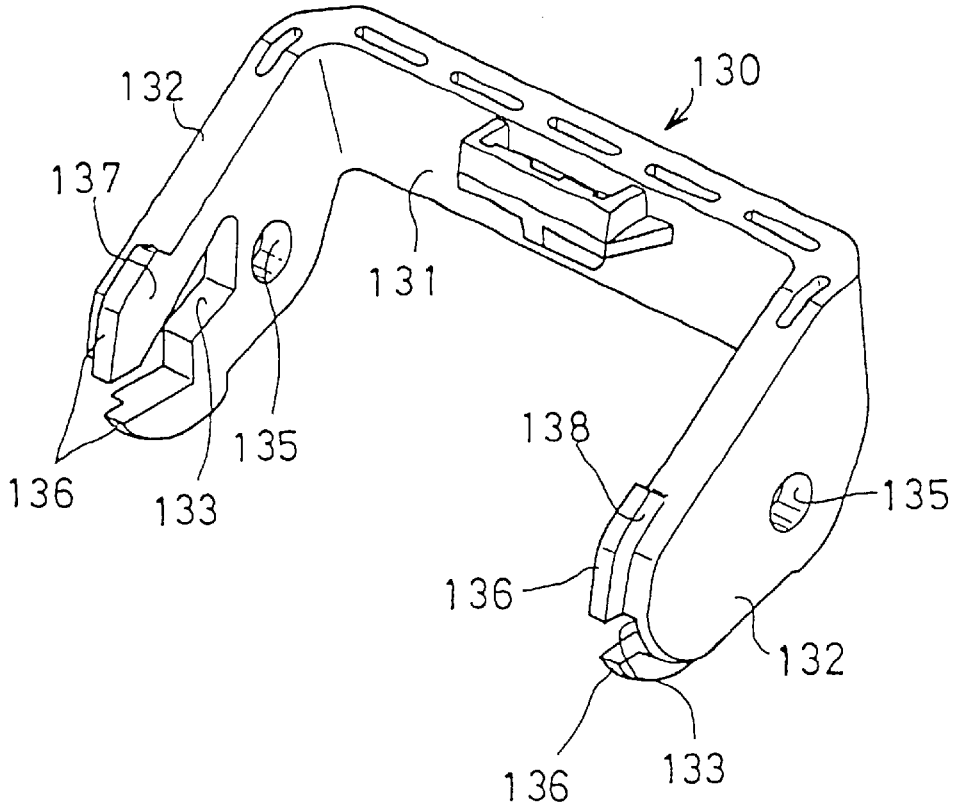
FIG. 9 is a perspective view of a lever employed in the lever connector of the second embodiment.
Figure 10:
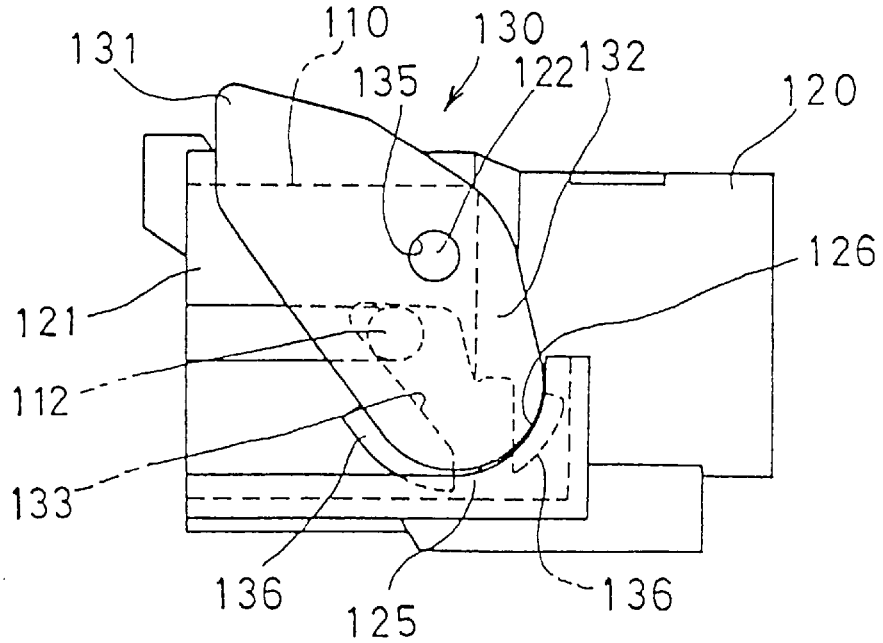
FIG. 10 is a side view of the lever connector with the female and male connector housings in the fitted state.
Figure 11:
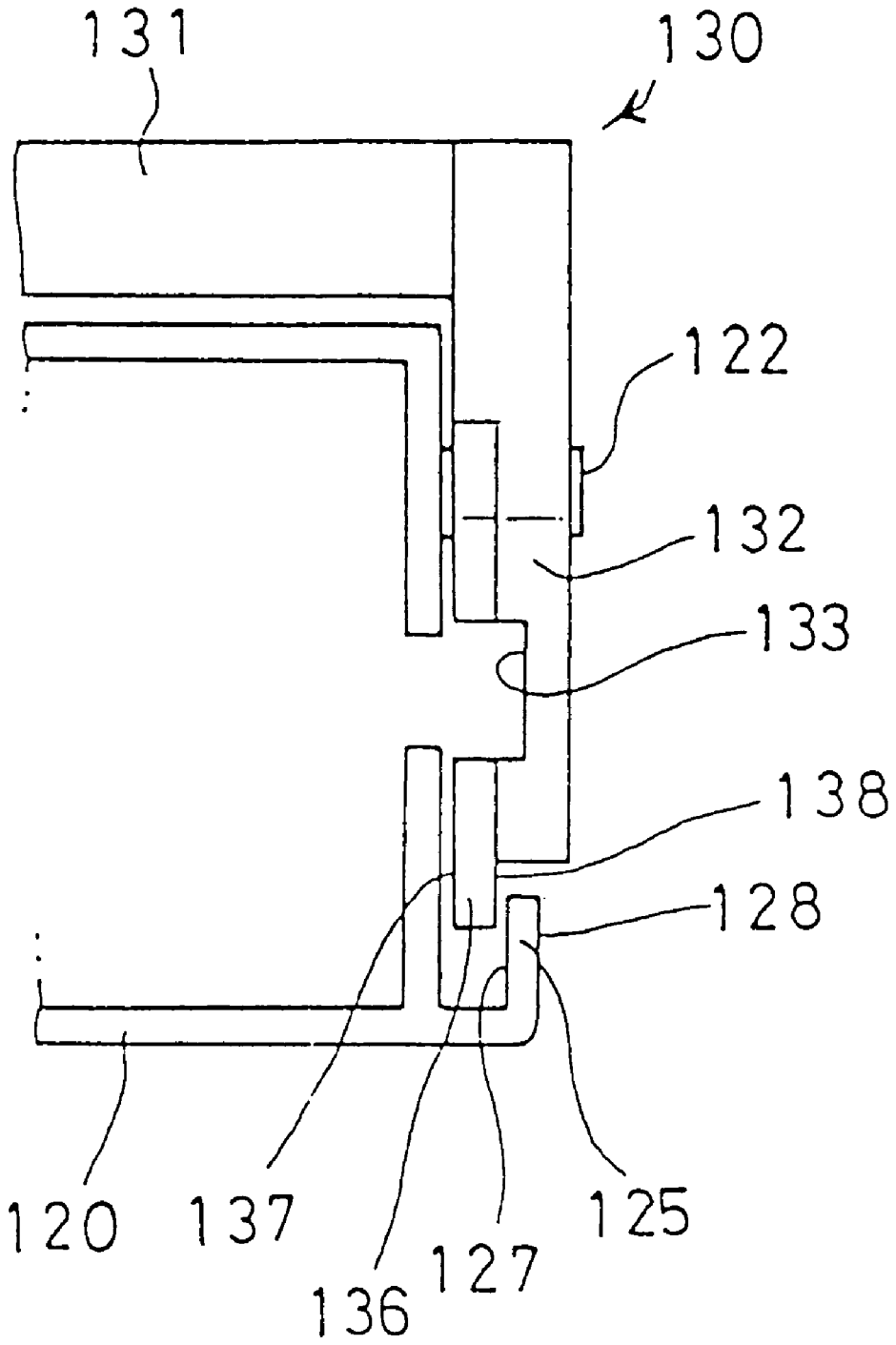
FIG. 11 is a front view of a failing-off preventing mechanism of the lever.

FIGS. 8 to 11 illustrate a second embodiment. Referring to FIG. 8, an overall construction of a lever connector is shown. The lever connector comprises a female connector housing 110 and a male connector housing 120 having a hood 121 into which the female connector is inserted. Terminals (not shown) are disposed in respective cavities 111 defined in the female connector housing 110. Terminals are also disposed in respective cavities (not shown) defined in the male connector housing 120. The terminals in the respective connector housings 110 and 120 are electrically connected together when the female and male connector housings 110 and 120 are fitted by means which will be described later.

An elastically deformable lever 130 formed from a resin is mounted to the male connector housing 120. The lever 130 includes a lever base 131 and two plate-shaped arms projecting from ends of the base 131 and is formed generally into a U-shape. Describing the mounting structure for the lever 130, the arms 132 are elastically deformed so as to spread. Two support shafts 122 projecting from opposite side walls of the male connector housing 120 are fitted into bearing holes 135 approximately centrally formed in the arms 132 so that the lever 130 is rotatably mounted on the male connector housing 120. Since the arms 132 of the lever 130 are loosely fitted in the respective bearing holes 135, the arms 132 are movable outwardly relative to the respective support shafts 122.

A cam groove 133 is formed on the inner side face of each arm 132 of the lever 130 so as to be open at the outer peripheral face of the arm 132. Engagement pins 112 coaxially projecting from both outer side faces of the female connector housing 110 are engaged with the cam grooves 133, respectively.

In fitting both connector housings 110 and 120, the female connector housing 110 is inserted slightly into a hood 121 of the male connector housing 120 so that the engagement pins 112 are inserted into openings of the cam grooves 133. Upon turning of the lever 130 in this state, both connector housings 110 and 120 are drawn nearer to each other by the engagement of the engagement pins 112 with the respective cam grooves 133, whereby the female connector housing 110 is fitted deep into the hood 121 such that the terminals in both connector housings are electrically connected together.

An excessively large torque is applied to each arm 132 when the lever 130 is turned. Accordingly, the arms 132 tend to be flexed outwardly such that the engagement pins 112 are disengaged from the cam grooves 133. If the arms 132 should be flexed outwardly, they would fall off from the respective support shafts 122. In view of this problem, the male connector housing 120 is provided with means for preventing the respective arms 132 from being flexed and falling off from the support shafts 122. The construction of the means will be described as follows.

Falling-off preventing walls 125 are formed on both outer side faces of the male connector housing 120 to be parallel to the respective arms 132. Each all 125 has an arc-shaped portion 126 along a locus of a distal edge of the arm 132 in the case where the lever 130 is turned so that connector housings 110 and 120 are fitted together. An inner wall surface 127 of each wall 125 is located approximately midway of the thickness of the arm 132 and an outer wall surface 128 thereof is located slightly inside the outer side face of the arm 132.

A plate-shaped falling-off preventing engagement portion 136 is formed on the outer peripheral face of each arm 132 at its distal end side so as to be parallel to the arm 132. A portion of each engagement portion 136 corresponding to the opening of the cam groove 133 is cut out such that each engagement portion 136 is divided into two sections. An inner face 137 of each engagement portion 136 is planar with the inner face of each arm 132. An outer engagement face 138 of each engagement portion 136 is located approximately midway of the thickness of each arm 132. The engagement face 138 of each engagement portion 136 faces the inner walls surface 127 of the wall 125 with a small space therebetween.

The operation of the lever connector of the embodiment will be described. Each engagement portion 136 is positioned inside the wall 125 with a small space therebetween when the lever 130 is turned to fit both connector housings 110 and 120 together. In this regard, when each arm 132 is caused to flex outwardly, the outer engagement face 138 of each engagement portion 136 is abutted against the inner wall surface 127 of each wall 125 when each arm 132 has been slightly flexed. Further outward flexure of each arm 132 is prevented by the engagement of each engagement portion 136 with the wall 125. Consequently, each arm 132 is prevented from falling off from the support shaft 122.

The outer wall surface 128 of each wall 125 preventing the falling-off of the arm 132 from the support shaft 122 is located inside the outer side face of the arm 132. Accordingly, each wall 125 does not just outside the arm 132 and the width of the male connector housing 120 is rendered as small as possible.

Third Embodiment

Figure 12:
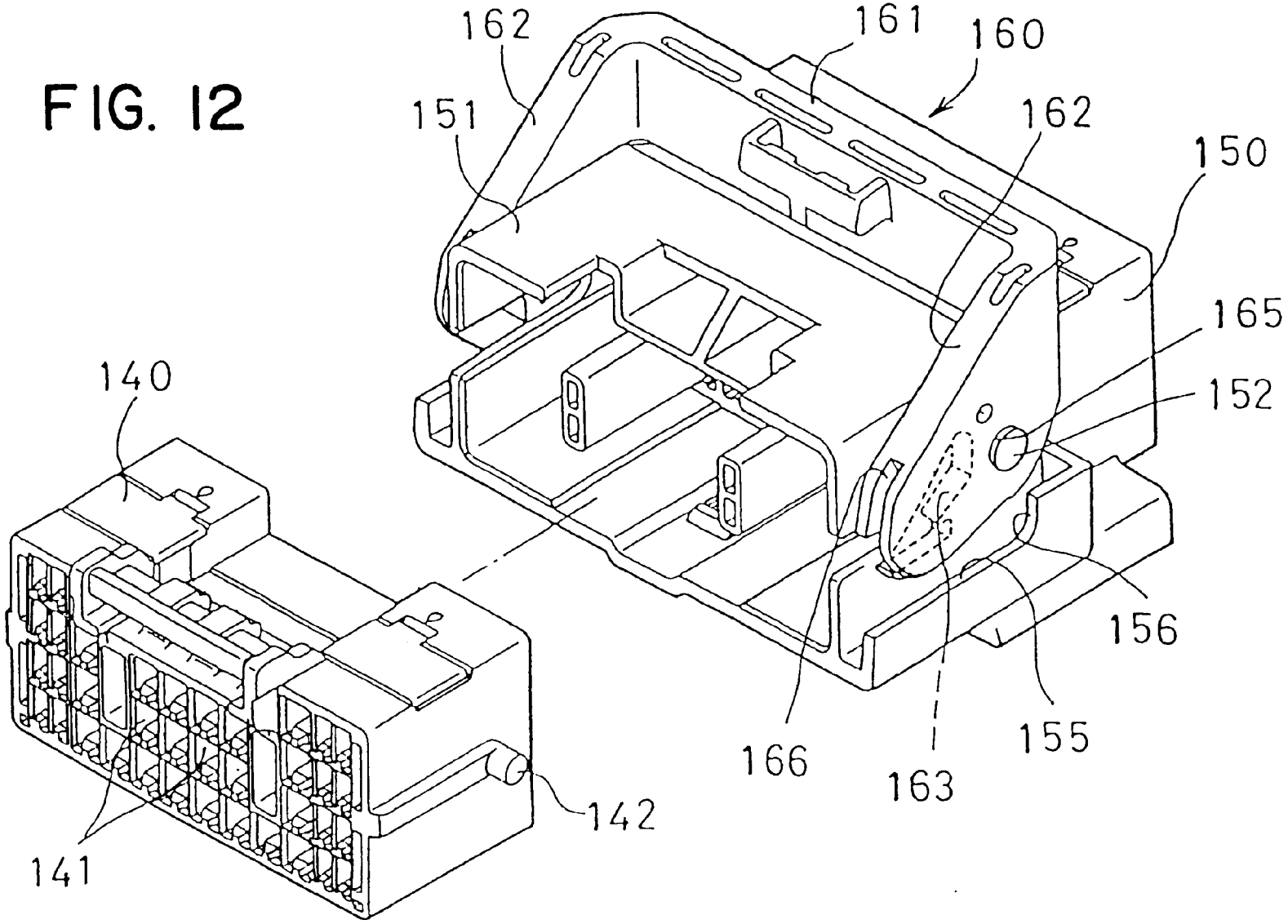
FIG. 12 is a perspective view of an overall construction of a lever connector of a third embodiment in accordance with the present invention.
Figure 13:
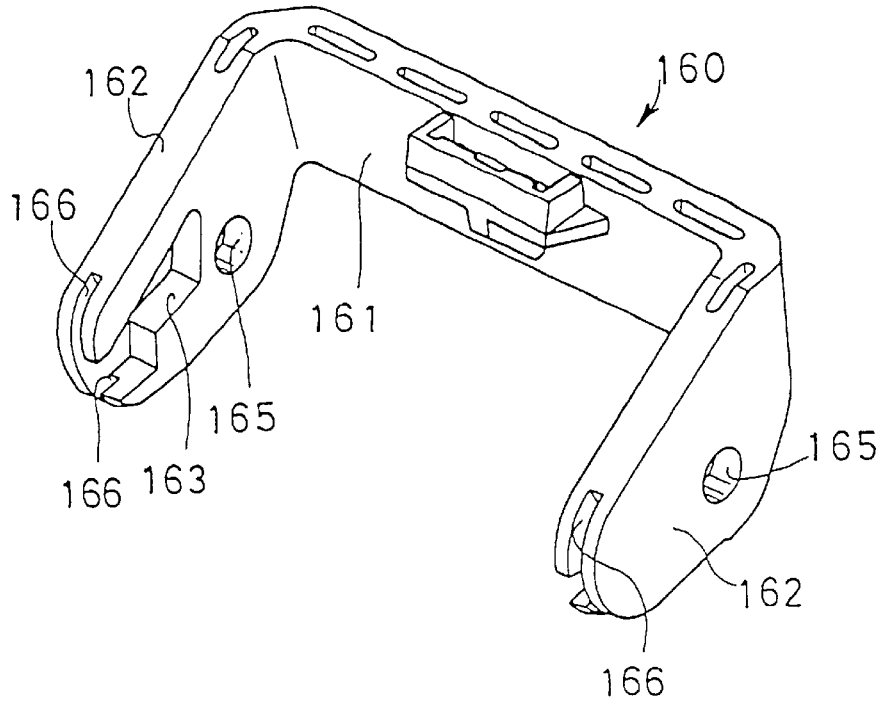
FIG. 13 is a perspective view of a lever employed in the lever connector of the third embodiment.
Figure 14:
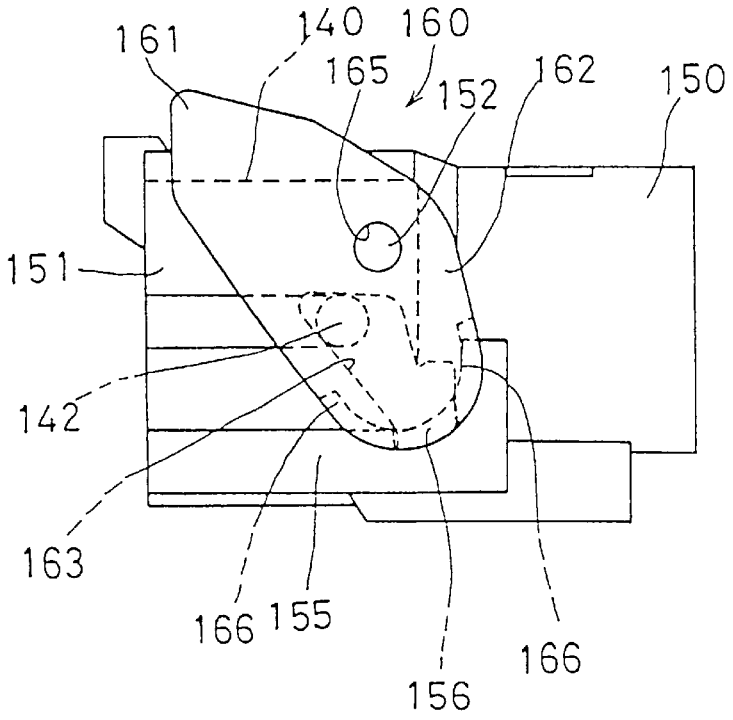
FIG. 14 is a side view of the lever connector of the third embodiment with the female and male connector housings in the fitted state.
Figure 15:
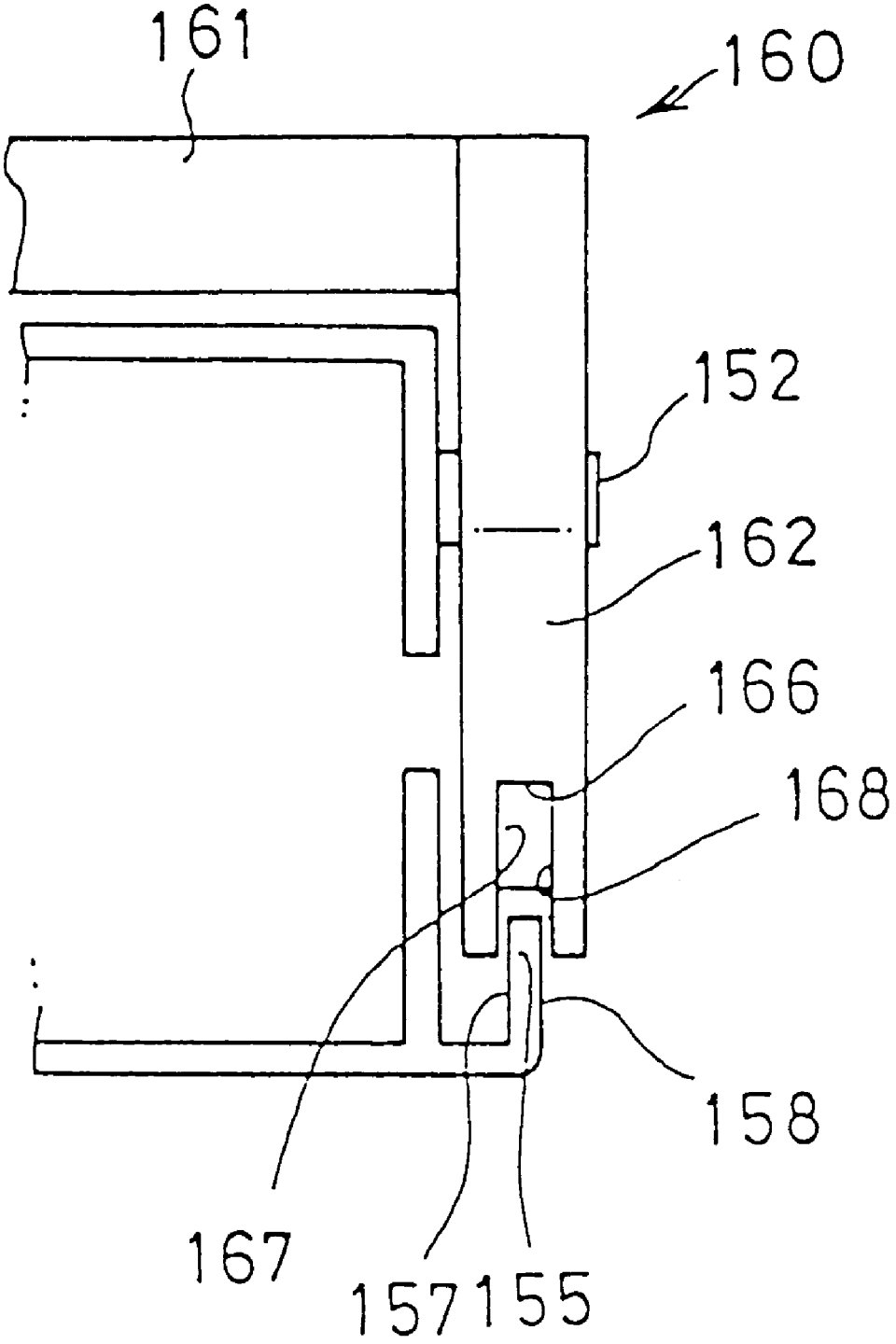
FIG. 15 is a front view of a falling-off preventing mechanism of the lever in the third embodiment.
Figure 16:
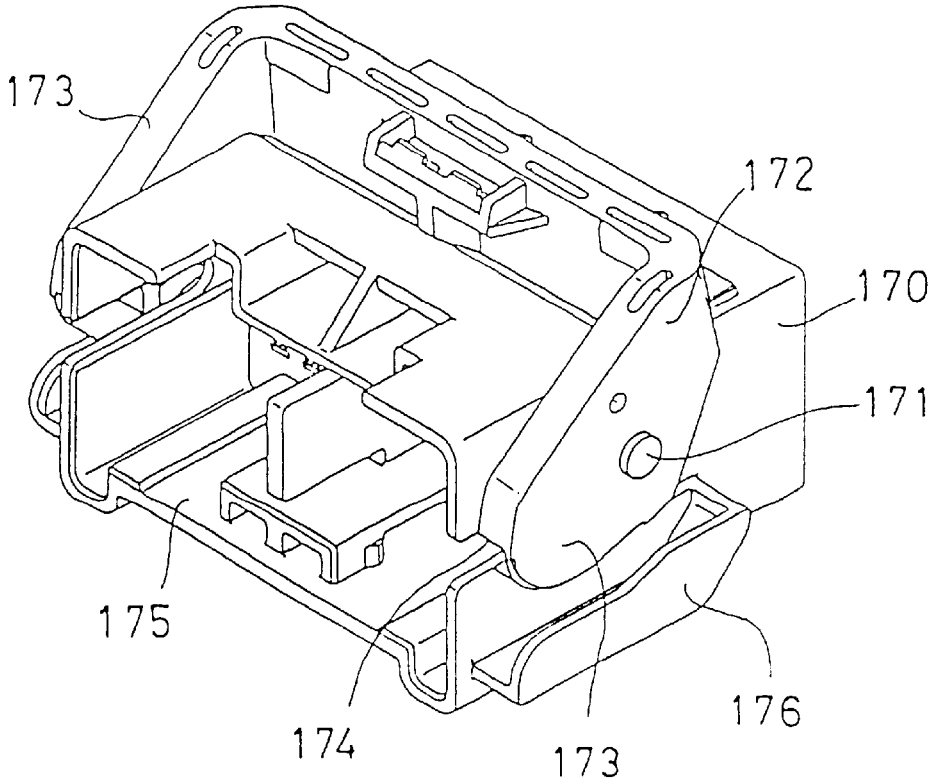
FIG. 16 PRIOR ART
FIG. 16 is a perspective view of a male connector housing of another prior art lever connector.
Figure 17:
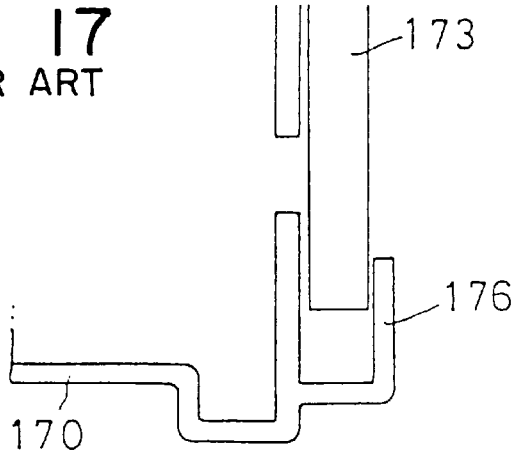
FIG. 17 PRIOR ART
FIG. 17 is a front view of a falling-off preventing mechanism of the lever in another prior art lever connector.

FIGS. 12 to 15 illustrate a third embodiment of the invention. Referring to FIG. 12, an overall construction of a lever connector is shown. The lever connector comprises a female connector housing 140 and a male connector housing 150 having a hood 151 into which the female connector housing 140 is fitted. Terminals (not shown) are disposed in cavities 141 formed in the female connector housing 140. Terminals are also disposed in cavities (not shown) formed in the male connector housing 150. The terminals in the respective connector housings 140 and 150 are electrically connected together when the female and male connector housings 140 and 150 are fitted by means which will be described later.

An elastically deformable lever 160 formed from a resin is mounted to the male connector housing 150. The lever 160 includes a lever base 161 and two plate-shaped arms 162 projecting from respective ends of the base 161 and is formed generally into a U-shape. Describing the mounting structure for the lever 160, the arms 162 are elastically deformed so as to spread. Two support shafts 152 projecting from opposite side walls of the male connector housing 150 are fitted into bearing holes 165 approximately centrally formed in the arms 162 so that the lever 160 is rotatably mounted on the male connector housing 150. Since the arms 162 of the lever 160 are loosely fitted in the respective bearing holes 165, the arms 162 are movable outwardly relative to the respective support shafts 152.

A cam groove 163 is formed on the inner side face of each arm 162 of the lever 160 so as to be open at the outer peripheral face of the arm 162. Engagement pins 142 coaxialy projecting from opposite side walls of the female connector housing 140 are engaged with the cam grooves 163, respectively.

In fitting both connector housings 140 and 150, the female connector housing 140 is inserted slightly into a hood 151 of the male connector housing 150 so that the engagement pins 142 enter respective openings of the cam grooves 163. Upon turning of the lever 160 in this state, both connector housings 140 and 150 are drawn nearer to each other by the engagement of the engagement pins 142 with the respective cam grooves 163 caused by the turning of the lever 160, whereby the female connector housing 140 is fitted deep into the hood 151 such that the terminals, are electrically connected together.

An excessively large torque is applied to each arm 162 when the lever 160 is turned. Accordingly, the arms 162 tend to be flexed outwardly such that the engagement pins 142 are disengaged from the cam grooves 163. If the arms 162 should be flexed outwardly, they would fall off from the respective support shafts 152. In view of this problem, the male connector housing 150 is provided with means for preventing the arms 162 from being flexed and falling off from the support shafts 152. The construction of the means will be described as follows.

Falling-off preventing walls 155 are formed on both outer side faces of the male connector housing 150 to be parallel to the respective arms 162. Each wall 155 has an parallel arc-shaped portion 156 which is coaxial with a locus of a distal edge of the arm 162 in the case where the lever 130 is turned so that both connector housings 110 and 120 are fitted together, and has a diameter smaller than the locus. An inner wall surface 157 of each wall 155 is located approximately midway of the thickness of the arm 162 and an outer wall surface 158 thereof is located slightly inside the outer side face of the arm 162.

A falling-off preventing engagement portion 166 is formed by cutting the outer peripheral face of each arm 162 at its distal end side into a groove. A portion of each engagement portion 166 corresponding to the opening of the cam groove 163 is cut out such that each engagement portion 166 is divided into two sections. An inner face 167 of each engagement portion 166 faces the inner wall surface 157 of each wall 155 with a small space therebetween. A small space is defined between an outside inner face 168 of each engagement portion 166 and an outer wall surface 158 of each wall 155.

The operation of the lever connector of the embodiment will be described. By turning the lever 160 for the fitting of both connector housings 140 and 150, the falling-off preventing walls 155 are inserted into the respective grooves of the engagement portions 166. In this regard, when each arm 162 is caused to flex outwardly, the inside inner face 167 of each engagement portion 166 is abutted against the inner wall surface 157 of each wall 155 when each arm 162 has been slightly flexed. Further outward flexure of each arm 162 is prevented by the engagement of each engagement portion 166 with the wall 155. Consequently, each arm 162 is prevented from being disconnected from the support shaft 152.

Each wall 155 preventing the falling-off of the arm 162 from the support shaft 152 is located inside the outer side face of the arm 162 in the embodiment. Accordingly, each wall 155 does not just outside the arm 162 and the width of the male connector housing 150 is rendered as small as possible.

The lever connector of the present invention should not be limited to the above-described embodiment, and may be modified in practice as follows, for example. The lever is attached to the male connector housing and the engagement pins are provided on the female connector housing in the above-described embodiment. However, the lever may be attached to the female connector housing and the engagement pins may be formed on the male connector housing.

We claim:

1. A lever connector comprising:

a female connector housing;

a male connector housing having a hood for receiving said female connector housing;

an engagement pin on one of said female connector housing and said male connector housing, said engagement pin having an outer diameter;

a lever pivotally mounted on the other of said female connector housing and said male connector housing, said lever having a cam groove having a width for receiving said engagement pin therein, and said lever being pivotal between a first position in which said cam groove is positioned such that said engagement pin can be introduced into said cam groove so as to assume a preliminary fitting position and said female connector housing can be introduced into said hood of said male connector housing, and a second position in which said engagement pin has been moved due to engagement by said cam groove into a final fitted position and said female and male connector housings have been moved together into a final fitted state; and a protrusion positioned on said cam groove such that when said lever is in said first position and said engagement pin is in said preliminary fitting position, said protrusion prevents said engagement pin from coming out of said preliminary fitting position outside of said cam groove;

wherein said cam groove has an opening for receiving said engagement pin, and said protrusion is positioned on said cam groove such that it is spaced inwardly of said opening along said cam groove, said protrusion reducing the width of said cam groove at said protrusion and adjacent to said opening to a size smaller than said outer diameter of said engagement pin.

2. The lever connector of claim 1, wherein said protrusion comprises two protrusions extending toward each other from opposite side walls of said cam groove.

3. The lever connector of claim 1, wherein said lever is arranged such that when said lever is in said first position, said engagement pin can be inserted into an open end of said cam groove, into contact with said protrusion, and past said protrusion into said preliminary fitting position, at the same time that said female connector housing is introduced into said hood of said male connector housing, and such that when said lever is in said second position, said engagement pin has been moved by said cam groove from said preliminary fitting position to a portion of said cam groove that is further from said protrusion than said preliminary fitting position.

4. The lever connector of claim 1, wherein said cam groove has one open end and another end remote from said open end, said preliminary fitting position is between said open end and said another end, said protrusion is between said preliminary fitting position and said open end and said final fitted position is closer to said another end than said preliminary fitting position.

5. The lever connector of claim 1, wherein said protrusion on said cam groove defines a concavity and said engagement pin defines a convexity for engagement with said concavity.

6. The lever connector of claim 5, wherein said lever has an axis of rotation, said cam groove has one end thereof open at an end of said lever and another end distant from the one end, and said cam groove comes closer to said axis of rotation of said lever as said cam groove comes closer to the other end thereof, said protrusion being located adjacent to said one end of said cam groove.

7. The lever connector of claim 6, wherein said engagement pin has a side surface, and said protrusion abuts said side surface of said engagement pin when said protrusion and said engagement pin contact each other.

8. A lever connector comprising:

a female connector housing;

a male connector housing having a hood for receiving said female connector housing;

an engagement pin on one of said female connector housing and said male connector housing, said engagement pin having an outer diameter;

a lever pivotally mounted on the other of said female connector housing and said male connector housing, said lever having a cam groove for receiving said engagement pin therein, and said lever being pivotal between a first position in which said cam groove is positioned such that said engagement pin can be introduced into said cam groove so as to assume a preliminary fitting position and said female connector housing can be introduced into said hood of said male connector housing, and a second position in which said engagement pin has been moved from said preliminary fitting position due to engagement by said cam groove into a final fitted position and said female and male connector housings have been moved together into a final fitted state; and means positioned on said cam groove which reduces a width of said cam groove at a position adjacent to an opening of said cam groove to a size smaller than said outer diameter of said engagement pin for, when said lever is in said first position and said engagement pin is in said preliminary fitting position, preventing said engagement pin from coming out of said preliminary fitting position to the outside of said cam groove.

* * * * *